US008151463B1

(12) United States Patent
Kundel, Sr.

(10) Patent No.: US 8,151,463 B1
(45) Date of Patent: Apr. 10, 2012

(54) PROCESS FOR MAKING A PANEL FOR SUPPORTING THE WALLS OF AN EXCAVATION

(76) Inventor: Robert Kundel, Sr., Cortland, OH (US)

( * ) Notice: Subject to any disclaimer, the term of this patent is extended or adjusted under 35 U.S.C. 154(b) by 544 days.

(21) Appl. No.: 12/386,036

(22) Filed: Apr. 13, 2009

Related U.S. Application Data

(62) Division of application No. 11/268,308, filed on Nov. 7, 2005, now Pat. No. 7,611,308.

(51) Int. Cl.
*B21D 47/00* (2006.01)

(52) U.S. Cl. ..... 29/897.31; 29/428; 29/897; 29/897.3; 249/41; 249/49; 249/189; 249/190; 249/192; 405/272; 405/282; 405/283

(58) Field of Classification Search ..... 29/428, 29/897.3, 897.31, 897.312, 897.32; 249/41, 249/49, 189, 190, 192; 405/272, 273, 274, 405/282, 283
See application file for complete search history.

(56) References Cited

U.S. PATENT DOCUMENTS

| | | | | |
|---|---|---|---|---|
| 841,773 | A | 1/1907 | Fitzgerald | |
| 2,188,077 | A | 1/1940 | Dowd | |
| 2,246,623 | A | 6/1941 | Dorey | |
| 2,260,423 | A | 10/1941 | Washbourne | |
| 3,362,674 | A * | 1/1968 | Gilbert | 249/49 |
| 3,393,521 | A | 7/1968 | Cammisa | |
| 3,593,528 | A | 7/1971 | Pavese | |
| 4,054,033 | A | 10/1977 | Pillosio | |
| 4,114,383 | A | 9/1978 | Nieber | |
| 4,364,203 | A | 12/1982 | Seaholm et al. | |
| 4,993,880 | A | 2/1991 | Collins | |
| 5,232,312 | A | 8/1993 | Jennings et al. | |
| 5,290,129 | A | 3/1994 | Rody et al. | |
| 5,503,504 | A | 4/1996 | Hess et al. | |
| 5,876,153 | A | 3/1999 | Krings | |
| 5,885,033 | A | 3/1999 | Krings | |
| 6,443,665 | B1 | 9/2002 | Kundel, Sr. | |

FOREIGN PATENT DOCUMENTS

EP 0167991 A2 1/1986

OTHER PUBLICATIONS

Website pp. showing excavation panels manufactured by Kundel Industries, Inc. of 292 Forrest Street, NW, Warren, Ohio 44484 (date unknown) at www.kundel.com, 18 pages.
Partial translation of EP 0167991 (4 pgs.).

* cited by examiner

*Primary Examiner* — Richard Chang
(74) *Attorney, Agent, or Firm* — Robert J. Herberger

(57) ABSTRACT

A process for making a panel for supporting the sidewalls of an excavation includes a plate, longitudinal members and vertical members. Each longitudinal member includes a first leg extending along the length, substantially parallel to and spaced laterally from the plate. The first leg of each longitudinal member being located adjacent and secured to the first leg of another member. A second leg, integral with the first leg, extends along the length, away from the first leg and toward the plate, the second leg being secured to the plate. Axially spaced vertical members are welded to the plate and to the longitudinal members.

18 Claims, 5 Drawing Sheets

PROCESS FOR MAKING A PANEL FOR SUPPORTING THE WALLS OF AN EXCAVATION

This application is a divisional of U.S. patent application Ser. No. 11/268,308, filed Nov. 7, 2005 now U.S. Pat. No. 7,611,308, the full disclosure of which is incorporated herein by reference.

BACKGROUND OF THE INVENTION

This invention relates to the process for making a trench box for protecting against a collapse of the sidewalls of an excavation. More specifically, the instant invention pertains to panels of the trench box.

It is conventional to fabricate a panel for a trench box using laterally spaced steel U-shaped longitudinal channels, or as an alternative using laterally spaced tubes, located between and attached to large flat steel plates. To reduce weight and material costs, the longitudinal channels or tubes are often spaced laterally a short distance. The longitudinal spaces between adjacent channels, or the gaps between adjacent tubes, are then closed locally by short spacers to provide patterned continuity and uniformity. Relatively, the spacers provide only nominal structural strength between adjacent longitudinal members. Lengthy spaces and gaps remain left where there are no spacers between adjacent channels or tubes. These spaces and gaps cause the panels to have discontinuous bending stiffness and strength required to resist external loads tending to bend the panel across its width.

To compensate for this deficiency, vertical stiffeners, which are usually extruded channels, are placed at spaced locations along the panel's length and secured to the longitudinal channels. Except at the locations of the vertical stiffeners, panels fabricated in this way lack uniform bending stiffness across the panel's width. Due to changes in the moment of inertia of the bending cross-section that occurs at each longitudinal space between adjacent longitudinal channels, bending loads are concentrated near the vertical stiffeners and short channels rather than being carried uniformly across the entire length of the panel. This concentration of loading lowers the structural efficiency of the panel and requires use of thicker metal and heavier cross sections to reach the stiffness and strength that would result if the full panel length were uniformly active in resisting lateral bending.

A large inventory of U-shaped longitudinal channels with various thicknesses and dimensions, or multiple tubes having different lengths, widths, wall thickness and diameters is required to properly engineer and assemble panels of this type so as to provide the needed structural strength for the particular situation. As a result, a manufacturer must either make a significant financial investment to keep an adequate inventory of longitudinal members to choose from or order the required members once appropriate sizes and dimensions are determined. In both cases, the manufacturer is either delayed or forced to incur increased overhead costs. This problem is aggravated with the escalation or unpredictable fluctuation in steel prices. Furthermore, because a conventional panel fabricated as described may have relatively large areas of overlapping thicknesses of the extruded, bent, shaped and/or formed members, the panel typically has unnecessary excess weight.

Still further, the complexity to fabricate and assemble such panels adds to the time, engineering and cost of assembly. One of the more significant problems faced when fabricating U-shaped longitudinal channels, for example, is the bending of a flat sheet on a brake press to make the required U-shape with appropriate leg or web dimension and spacing. More specifically, to increase the strength of the longitudinal member to resist bending along its length, engineering may require the U-shaped channel have a short width with long parallel legs, thereby increasing the webbing and overall thickness of the finished panel. With such a design, however, it becomes difficult, if not impractical, to bend sheet steel on a brake press to make the appropriately dimensioned U-shaped cross-section. With the closely aligned extended legs, the length of the first bent leg interferes with the brake press during the bending of the second leg, thereby preventing the needed 90° bend.

The alternative may be to use a tube with a larger diameter and thicker wall. However, this design makes for other engineering problems.

In order to eliminate the costs associated with specially fabricating and maintaining large inventories of U-shaped longitudinal channels and tubes for each of the multiple dimensioned profiles, it is desirable to provide a channel profile and assembly that can be easily and quickly fabricated to multiple dimensions from stock sheet steel, while providing more engineering versatility, improved structural strength and reliability. It is therefore an objective of the present invention to provide such a profile and fabricating mechanism.

SUMMARY OF THE INVENTION

A process for making a panel, according to the present invention, for supporting the walls of an excavation includes the steps of taking a plate, preferably a rectangular plate, and securing parallel longitudinal members to the plate, arranged across the plate's width. Each longitudinal member has an L-shaped cross-section with a first leg substantially parallel to and spaced laterally from the plate, the first leg of each longitudinal member being located adjacent and secured to the first leg of another member. Each second leg extends along the length away from the first leg and toward the plate, the second leg being secured to the plate. A lower edge member, secured to a first leg of the lowermost longitudinal member is inclined toward and secured to the plate, forming a wedge with the plate. The wedge extends along the panel's length and has a tip located at the lower edge of the panel.

Channel-shaped vertical stiffeners are spaced mutual along the length; each include a web substantially parallel to and spaced laterally from the plate, and secured to the first leg of each adjacent longitudinal member. Legs integral with the web extend along the length away from the web and toward the plate. The legs are also secured to the plate.

A distributed load that would be applied to the panels of a trench box by the walls of an excavation induces double curvature bending of the panels due to distribution of the load along the panel length and across its width. The vertical stiffeners and the longitudinal members are closed by the plate, thereby forming ideal structural sections having upper flanges and lower flanges that are continuous across the panel's width and provide stiffness that resists bending in those directions. Similarly, bending along the panel length is resisted by box sections formed by the legs of the L-shaped longitudinal members and the plate. Local compression instability of the plate is resisted by baffles, which also provide enhanced structural continuity due to their being welded to the longitudinal members and the plate.

The weight of a trench box assembly fabricated according to this invention is light compared to a conventional trench box having similar structural and functional capacity and made of the same material. This weight advantage is realized principally because use of overlapping, redundant material thicknesses is minimized without compromising the strength and stiffness of the panel.

Fabrication of a trench box panel according to the instant invention requires fewer components than would a conventional panel because the longitudinal members can be roll-formed from a single sheet that requires only one bend to form the legs of the L-shaped cross-section. Similarly, the vertical channel stiffeners and baffles can be quickly and easily roll-formed from sheet stock. Few extruded components having a wide range of dimensions and thicknesses are required, and therefore, fewer components need inventoried by the trench box manufacturer which is of particular importance with the increasing cost of steel and other metals. Mechanical connections are virtually eliminated because the components are welded. The lower wedge-shaped edge member is easily formed by welding a narrow, inclined plate to the outer plate and to the lowermost longitudinal member.

DESCRIPTION OF THE DRAWINGS

It is to be understood that the drawings are designed for the purpose of illustration only and not as a definition of the limits of the instant invention, for which reference should be made to the claims appended hereto. Other features, objects and advantages of this invention will become clear from the detailed description made with reference to the following drawings:

DESCRIPTION OF THE PREFERRED EMBODIMENT

Figure 1:
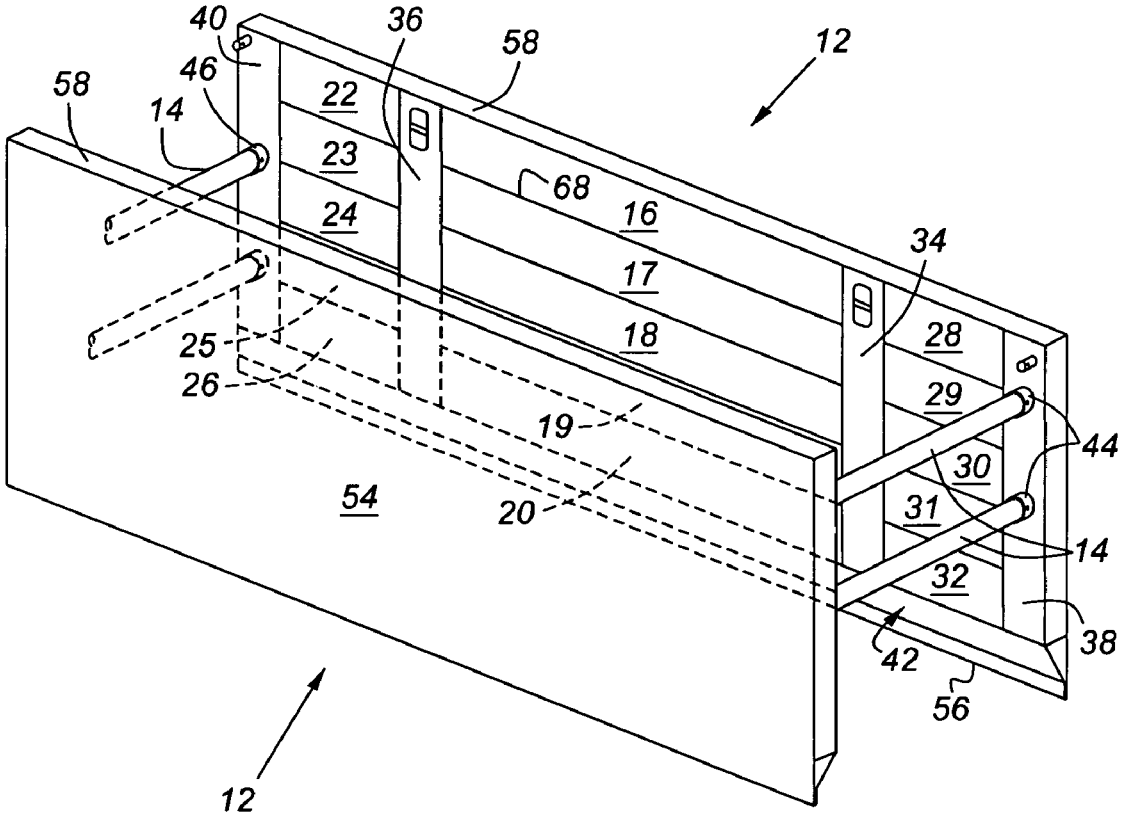
FIG. 1 is a perspective view of a trench shoring device employing panels according to the present invention.

Referring first to FIG. 1, a portable trench box for securing the walls of an excavation includes panels 12, each panel being located adjacent the earthen walls of the excavation and extending vertically from the base of the trench to its top and along its length. Additional panels can be located in the trench adjacent the axial ends of other panels in order to line the entire length of both walls of the trench with panels. Lateral spacing between the panels 12 is maintained by bars 14, which extend laterally across the width of the trench and are secured at opposite axial ends to each of the panels.

Figure 2:
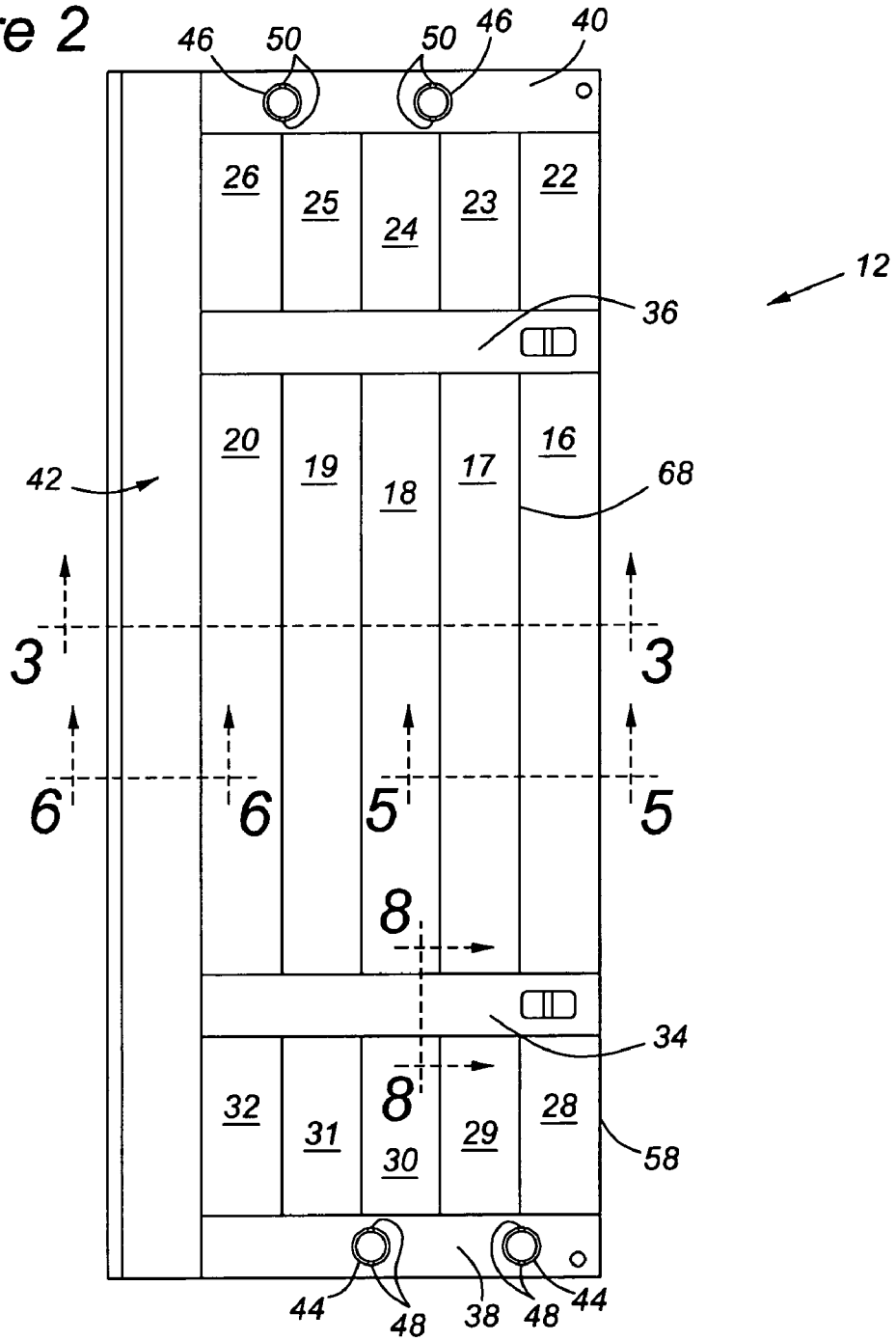
FIG. 2 is a front view of a panel for a trench box.
Figure 3:
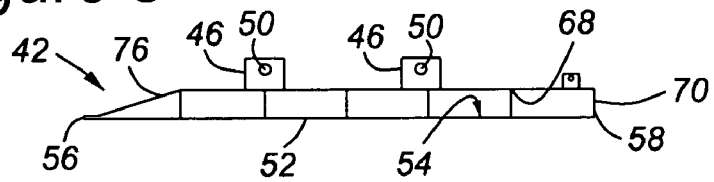
FIG. 3 is a cross-section taken at plane 3-3 of the panel of FIG. 2.
Figure 4:
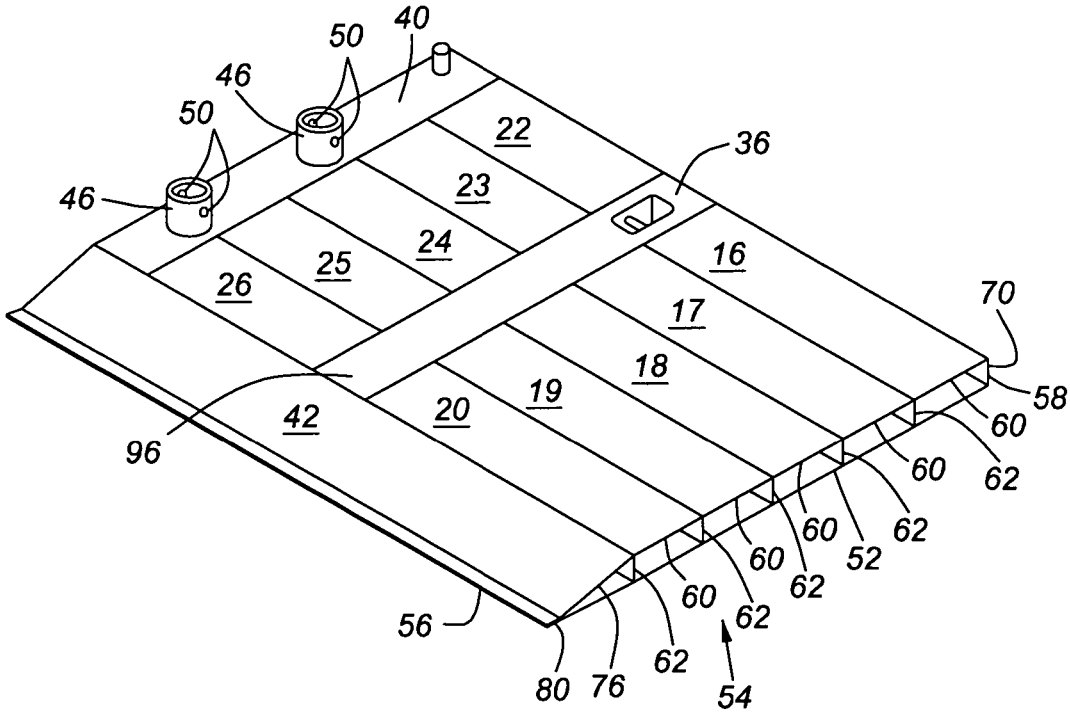
FIG. 4 is a perspective view of a portion of the length of the panel of FIG. 2.

Referring now to FIGS. 2-4, each panel 12 includes multiple central longitudinal members 16-20; multiple left-side longitudinal members 22-26; multiple right-side longitudinal members 28-32; intermediate vertical stiffeners 34, 36; and end vertical stiffeners 38, 40. The lower edge of the panel 12 is closed by a lower member 42, whose cross-section is preferably wedge-shaped to facilitate its being forced into the soil at the base of the trench adjacent the trench wall. Each axial end of the longitudinal members is secured to a vertical stiffener preferably at a welded connection. The lower member 42 is secured to each vertical stiffener 34, 36, 38, 40 and to the lowermost longitudinal members 20, 26, 32, preferably by a welded connection.

The end stiffener 38 supports vertically-spaced, hollow cylindrical plugs 44, which are secured to and extend inwardly from the inner surface of the stiffener 38. Similarly, end stiffener 40 supports vertically-spaced, hollow cylindrical plugs 46, which are secured to and extend inwardly from the inner surface of the stiffener 40. Each plug 44 is formed with aligned holes 48, which extend through the thickness of the plug wall. Each plug 46 is also formed with aligned holes 50, which extend through the thickness of the plug wall. Further, an end of each lateral bar 14 is formed with holes aligned with the holes 48, 50 of a respective plug, fits over one of the plugs, and engages the plug upon inserting a fastener through the aligned holes of the bar and the holes of the plug, thereby mutually securing the panels on opposite sides of the trench.

Each panel 12 includes an outer surface 52, which is a surface of a substantially flat rectangular plate 54 of metal that extends the full length of the panel 12 and extends laterally from the lower edge 56 of the lower member 42 to the upper edge 58 of the uppermost longitudinal members 16, 22, 28.

Figure 5:
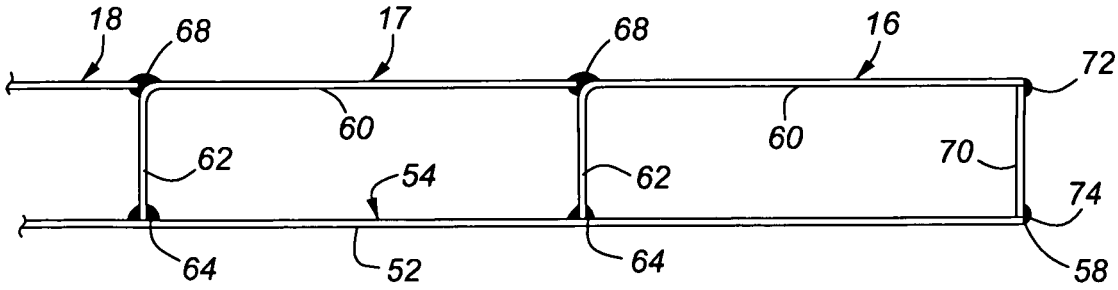
FIG. 5 is a cross-section taken at plane 5-5 of FIG. 2.

FIG. 5 illustrates, in cross-section, the assembled arrangement of longitudinal members 16, 17 and the plate 54. Each longitudinal member has a cross-section that is L-shaped having a first leg 60 and a second leg 62. When the panel 12 is assembled, the first legs 60 are substantially parallel to the outer surface 52 of the plate 54. But the second legs 62 are substantially perpendicular to the first legs 60 and plate 54, extend laterally toward plate 54, and are secured to the plate 54, preferably by a welded connection 64. The panel's inner surface includes the surfaces of the first legs 60 of the longitudinal members.

Each longitudinal member is secured to an adjacent longitudinal member at a welded connection 68. Each of the uppermost longitudinal members 16, 22, 28 is closed at the panel's upper edge 58 by a cap plate 70, which is a narrow, flat plate secured to the upper edge of the first leg 60 of the uppermost longitudinal members 16, 22, 28 at a weld 72 and secured to the upper edge of plate 54 at a weld 74.

Figure 6:
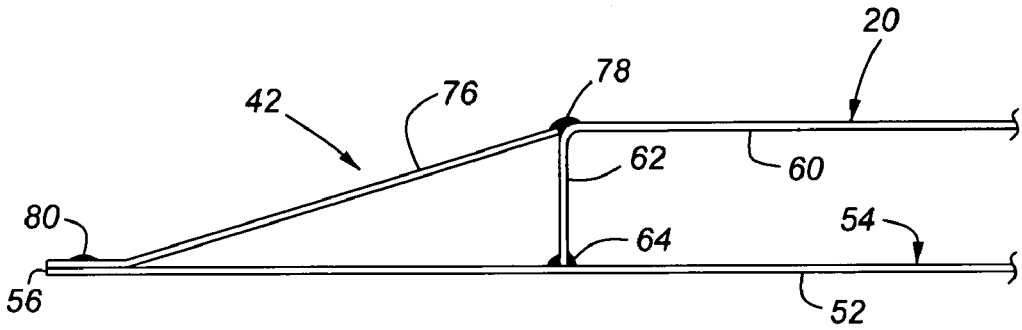
FIG. 6 is a cross-section taken at plane 6-6 of FIG. 2.

As illustrated in FIG. 6, the lower member 42 is closed at the lower edge 56 of the panel 12 by a lower edge member 76, i.e. a flat plate, which is secured to the first leg 60 of the lowermost longitudinal members 20, 26, 32 at a weld line 78, and is inclined toward and secured to plate 54 at a weld line 80. The plate 54 and lower edge member 76 together form a wedge having a point at the lower edge 56 of the panel 12 that extends along the panel's length.

Figure 7:
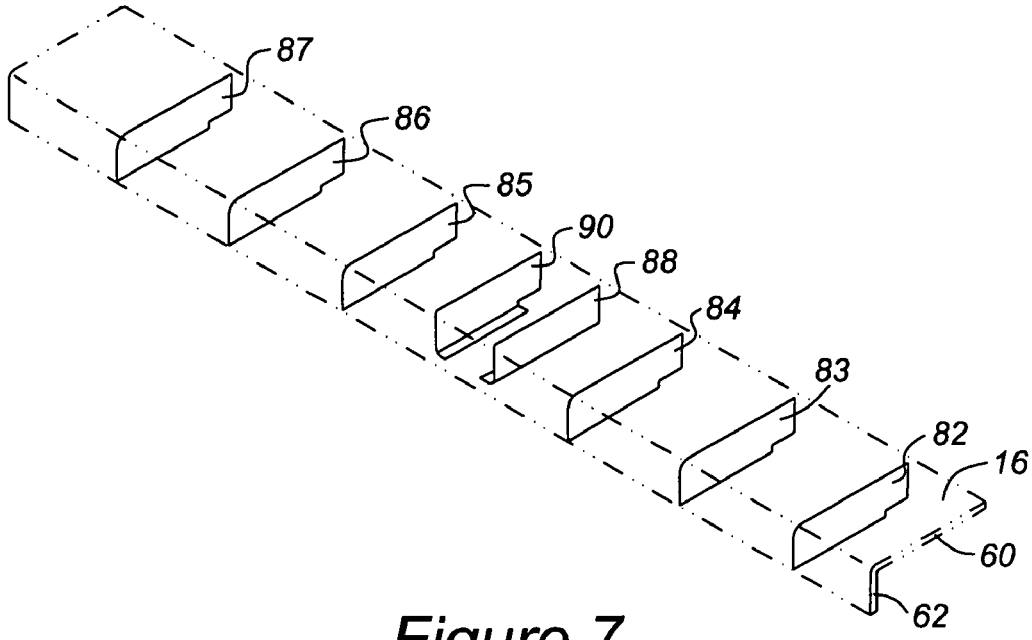
FIG. 7 is a perspective view of a longitudinal panel member showing stiffeners and baffles secured to the member.

Structural continuity between plate 54 and the first leg 60 of longitudinal members 16, 22, 28 may be provided by vertical baffles 82-87, 88, 90, which are located within the panel 12 and spaced mutually along the length of longitudinal member 16, or any of the longitudinal members, as FIG. 7 illustrates. The baffles 82-87, 88, 90 are welded to the inner surface of the first leg 60 and the inner surface of the second leg 62 after forming the longitudinal member 16 into its L-shape, but before assembling the panel 12. After the panel 12 is assembled, the baffles 82-87, 88, 90 are welded to the inner surface of the plate 54, and the cap plate 70 is installed and welded to the baffles.

Figure 8:
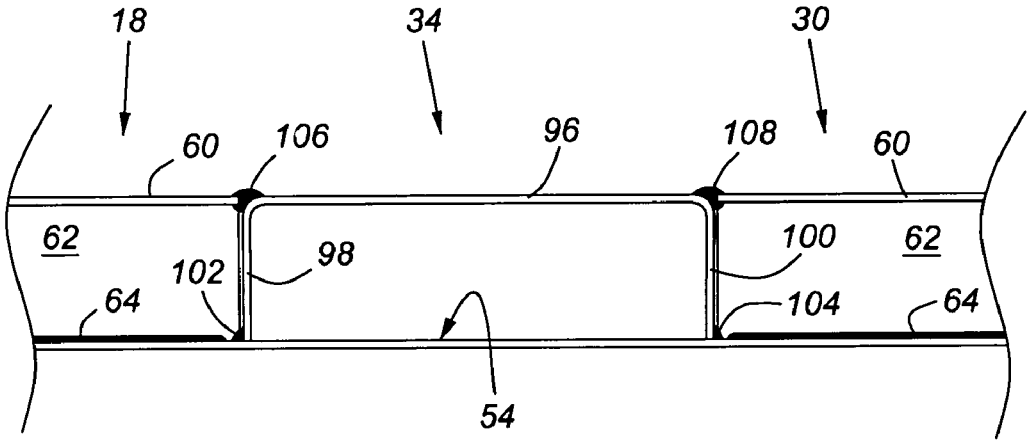
FIG. 8 is cross-section taken at plane 8-8 of FIG. 2.

In a preferred configuration illustrated in FIG. 8, the vertical stiffeners 34, 36, 40, 38 are channels having a web 96, located in the plane of the first legs 60 of the longitudinal members, and two legs 98, 100 that extend laterally toward and are secured to plate 54 by welds 102, 104. Similarly, welds 102, 104 may be used to secure the axial edges of the second legs 62 of the longitudinal members to the vertical stiffeners 34, 36, 40, 38. The axial edges of the first legs 60 of the longitudinal members that are located adjacent the vertical stiffeners 34, 36, 40, 38 are also secured to the vertical stiffeners by welds 106, 108.

Depending on the application, the flat plate 54 that forms the outer surface of the panel has a length of about 16 feet, a width of about 8 feet, and a thickness in the range 0.125-0.3125 inches. The L-shaped longitudinal members are roll formed from a flat sheet of steel stock having a width of about 18 inches and a thickness in the range 0.125-0.3125 inches. The longitudinal members, plates 54, 70, vertical stiffeners 34, 36, 40, 38, and baffles 82-87, 88, 90 are of substantially the same material, preferably high strength, low alloy steel sheet.

A distributed load that would be applied to the panels 12 of a trench box by the adjacent walls of an excavation induces double curvature in the panels due to bending along the panel length and bending across its width. The vertical stiffeners 34, 36, 40, 38 and the longitudinal members are closed by plate 54, thereby forming ideal structural sections having outer flanges and inner flanges that are continuous across the panel's width and provide stiffness that resists bending in that direction. Similarly, bending along the panel length is resisted by box sections formed by the legs 60, 62 of the L-shaped longitudinal members and plate 54. Local compression instability of plate 54 is resisted by the baffles 82-87, 88, 90, which also provide enhanced structural continuity due to their being welded to the longitudinal members and plates 54, 70.

The weight of a trench box panel 12 fabricated according to this invention is light compared to a conventional trench box having similar structural and function capacity and made of the same material principally because use of overlapping, redundant material thicknesses is minimized without compromising the strength and stiffness of the trench box. Further, with this invention the structural strength of the trench box panels 12 can be easily engineered by simply changing the width of the long versus short leg of the L-shaped longitudinal member. For example, to increase the strength of a trench box panel, the first leg is shortened and the second leg is lengthened so as to reduce the distance between the adjacent panels. Further, since each L-shaped longitudinal member is simply roll formed from a flat sheet of steel stock, the manufacturer needs to only inventory the flat steel sheets. Once the appropriate structural strength of the panel 12 is determined, each longitudinal member is bent from a flat sheet to the appropriate L-shaped dimension and then assembled as described above.

Although the first leg of the longitudinal members shown and described here has a greater width than that of the second leg, the first leg may, in certain applications, be equal or have a shorter width than that of the second leg.

Having described the preferred embodiment of the invention, it is to be understood that other versions are possible. Therefore, the spirit and scope of the appended claims should not be limited to the description of the preferred versions herein.

What is claimed is:

1. A process for making a panel for supporting a sidewall of an excavation, comprising the steps of:

cutting a flat sheet plate having a width and a length;

stacking multiple longitudinal members, each of the longitudinal members are formed from a planar sheet to have a L-shaped cross-section, including:

a first leg extending along the length and along a portion of the width of the flat sheet plate, substantially parallel to and spaced laterally from the plate, the first leg of each longitudinal member being located adjacent and secured by a weld to the first leg of another member; and a second leg integral with the first leg, extending along the length of the plate, away from the first leg and toward the plate, and the second leg being secured by a weld to the plate; and securing at least one vertical stiffener along the length of the plate, each stiffener extending in a direction of the width of the plate and having:

a web substantially parallel to and spaced laterally from the plate, with said web being secured to the first leg of each longitudinal member that converges substantially perpendicular to said vertical stiffener; and first and second stiffener legs integral with said web, said stiffener legs extending away from the corresponding web and toward the plate, and being secured to the plate.

2. The process of claim 1, further comprising:

welding vertical stiffeners to the one-piece plate and to the multiple adjacent longitudinal members, each stiffener located at an end of the length of the flat sheet plate; and securing an attachment plug to extend from a surface of the web away from the panel, the plug having a hole extending through a thickness of the plug.

3. The process of claim 2, further comprising:

securing upper vertical baffles spaced mutually along the length of the plate and located within the panel, each upper vertical baffle located adjacent and being secured by a weld to an inner surface of the plate, an inner surface of a first leg of an uppermost longitudinal member, and an inner surface of a second leg of the uppermost longitudinal member.

4. The process of claim 1, further comprising:

securing a cap plate extending along the length of the plate and laterally between the plate and a first leg of an uppermost longitudinal member at an upper edge of the panel.

5. The process of claim 4, further comprising:

securing baffles mutually along the length of the plate and located in a space within the panel, each baffle located adjacent and secured by a weld to the plate, the first leg of one of the multiple longitudinal members, and the second leg of the same longitudinal member.

6. The process of claim 5, further comprising:

extending a lower edge member along a portion of the width of the plate, secured by a weld to a first leg of a lowermost longitudinal member, inclined toward and secured by a weld to the plate, and forming a wedge with the plate that extends along the length of the plate, the wedge having a tip located at the lower edge of the panel.

7. A process for making a panel for supporting a sidewall of an excavation, comprising the steps of:

cutting a rectangular flat sheet plate having a width and a length;

aligning multiple L-shaped longitudinal members, each of the longitudinal members being one-piece and formed by a bend, and each aligned member including:

a first leg extending along the length and along a portion of the width of the plate, substantially parallel to and spaced laterally from the plate, the first leg of each longitudinal member being welded to the first leg of the adjacent longitudinal member; and a second leg integral with and substantially perpendicular to the first leg, extending along the length of the plate, away from the first leg and toward the plate, the second leg being secured by a weld to the plate; and spacing vertical stiffeners, each stiffener extending along the width of the plate, and each vertical stiffener including:

a web substantially parallel to and spaced laterally from the plate, and the web welded to the first leg of each longitudinal member that is adjacent the respective vertical stiffener; and first and second legs integral with the web, extending, away from the web and toward the plate, the first and second legs of each stiffener being welded to the plate.

8. The process of claim 7, further comprising:

securing a cap plate extending along the length of the plate and laterally between the plate and a first leg of an uppermost longitudinal member at an upper edge of the panel.

9. The process of claim 8, further comprising:

spacing baffles mutually along the length of the plate and located in a space within the panel, each baffle located adjacent and welded to the plate, the first leg of one of the multiple longitudinal members, and the second leg of the same longitudinal member.

10. The process of claim 8, further comprising:

spacing vertical baffles mutually along the length of the plate and located within the panel, each baffle located adjacent and welded to an inner surface of the plate, an inner surface of a first leg of an uppermost longitudinal member, and an inner surface of a second leg of the uppermost longitudinal member.

11. The process of claim 8, further comprising:

welding vertical end stiffeners to the plate and to the multiple adjacent longitudinal members, each end stiffener located at an end of the length of the plate, and including a web substantially parallel to and spaced laterally from the plate; and securing an attachment plug by weld to extend from a surface of the web away from the panel, the plug having a hole extending through a thickness of the plug.

12. The process of claim 8, further comprising:

securing a lower edge member extending along a portion of the width of the plate, welded to a first leg of a lowermost longitudinal member, inclined toward and welded to the plate, and forming a wedge with the plate that extends along the length of the plate, the secured wedge having a tip located at a lower edge of the panel.

13. A process for manufacturing a panel for supporting a sidewall of an excavation, comprising the steps of:

cutting a one-piece, flat sheet plate having a width and a length;

arranging multiple L-shaped longitudinal members, each longitudinal member having a bend to make first and second legs, the first leg extending along the length and along a portion of the width of the plate, substantially parallel to and spaced laterally from the one-piece plate, the first leg of each longitudinal member being located adjacent and secured by a weld to the first leg of another member;

securing the second leg to the plate to extend along the length of the plate, away from the first leg and toward the one-piece plate, the second leg being secured by a weld to the plate; and welding a lower edge member extending along a portion of the width to a first leg of a lowermost longitudinal member, inclined toward and secured to the one-piece plate to form a wedge with the plate that extends along the length of the plate, the wedge having a tip located at a lower edge of the panel.

14. The process of claim 13, further comprising the steps of:

welding vertical end stiffeners to the one-piece plate and to the multiple adjacent longitudinal members, each end stiffener located at an end of the length of the plate, and including a web substantially parallel to and spaced laterally from the plate; and securing an attachment plug to extend from a surface of the web away from the panel.

15. The process of claim 14, further comprising the step of:

securing vertical stiffeners, each stiffener being spaced mutual along the length of the plate, extending along the width of the plate, and each vertical stiffener including:

a web substantially parallel to and spaced laterally from the one-piece plate, and secured by a weld to the first leg of each multiple longitudinal member that is adjacent the respective vertical stiffener; and first and second stiffener legs integral with the web, extending along the width of the plate, away from the web and toward the one-piece plate, the first and second stiffener legs being secured to the plate.

16. The process of claim 15, further comprising the step of:

spacing baffles mutually along the length of the plate in a space within the panel, each baffle being located adjacent and secured by a weld to the one-piece plate, the first leg of one of the multiple longitudinal members, and the second leg of the same longitudinal member.

17. The process of claim 15, further comprising the step of:

spacing upper vertical baffles mutually along the length of the plate within the panel, each baffle being located adjacent and secured to an inner surface of the one-piece plate, an inner surface of a first leg of an uppermost longitudinal member, and an inner surface of a second leg of the uppermost longitudinal member.

18. The process of claim 16, further comprising the step of:

securing a cap plate extending along the length of the plate and laterally between the plate and a first leg of an uppermost longitudinal member at an upper edge of the panel.

* * * * *